United States Patent [19]

Chisum

[11] 4,100,320

[45] Jul. 11, 1978

[54] CUSTOM FITTED, LIGHT WEIGHT, AIR CONDITIONED PROTECTIVE HELMET

[75] Inventor: Gloria T. Chisum, Philadelphia, Pa.

[73] Assignee: The United States of America as represented by the Secretary of the Navy, Washington, D.C.

[21] Appl. No.: 662,475

[22] Filed: Mar. 1, 1976

Related U.S. Application Data

[62] Division of Ser. No. 463,944, Apr. 25, 1974, Pat. No. 3,956,773.

[51] Int. Cl.[2] ..... B32B 3/20; B32B 3/00

[52] U.S. Cl. ..... 428/188; 2/6; 2/411; 428/158; 428/166; 428/178

[58] Field of Search ..... 2/5–9, 2/171, 171.2, 171.3, 413, 414, 420, 138; 428/178, 188, 158, 161, 166, 156; 36/29, 44; 156/77–79, 310

[56] References Cited

U.S. PATENT DOCUMENTS

| | | | |
|---|---|---|---|
| 3,344,433 | 10/1967 | Stapenhill | 2/420 |
| 3,415,711 | 12/1968 | Chavannes | 428/178 |
| 3,577,305 | 5/1971 | Hines et al. | 428/178 |
| 3,609,764 | 10/1971 | Morgan | 2/414 |
| 3,787,893 | 1/1974 | Larcher | 2/413 |

*Primary Examiner*—George F. Lesmes
*Assistant Examiner*—P. Thibodeau
*Attorney, Agent, or Firm*—R. S. Sciascia; Henry Hansen

[57] ABSTRACT

A custom fitted pilot's helmet includes a liner attached within the confines of a helmet shell having numerous pressure relief holes over its entire surface. The liner includes a flexible sheet on one side of which is formed a plurality of elastic cell pairs separated by permanent heat seals or partitions overlaid with air tubes. The cells within a cell pair are separated from each other by a removable partition or severable heat seal. One cell of the cell pair contains one component of a foamable mixture and the other cell of the cell pair contains the second component of the foamable mixture. The liner-shell combination is positioned on the pilot's heat and the removable cell partitions are all virtually simultaneously removed. Thereafter, the foaming components within the cells admix and foam in situ to form a custom fitted helmet liner.

9 Claims, 6 Drawing Figures

CUSTOM FITTED, LIGHT WEIGHT, AIR CONDITIONED PROTECTIVE HELMET

STATEMENT OF GOVERNMENT INTEREST

The invention described herein may be manufactured and used by or for the Government of the U.S. of America for governmental purposes without the payment of any royalties thereon or therefor.

This is a division, of application Ser. No. 463,944 filed on Apr. 25, 1974, now U.S. Pat. No. 3,956,773 issued May 18, 1976.

BACKGROUND OF THE INVENTION

This invention relates to aircraft pilots' helmets and in particular to custom fitted helmets which are formed by a foaming process in situ.

Conventional pilot helmets have several drawbacks; they are generally ill-fitting, tend to become unbalanced during severe aircraft maneuvers and are undesirably heavy. These drawbacks are made less tolerable by the present day trend of using the helmet as an instrumentation platform. To help overcome these deliterious qualities, prior art practice has been directed toward providing most pilots with custom fitted helmets. Several approaches have been used in the past to form custom fitted helmets. One approach entails molding a pilot's head for a factory produced, head molded liner which is trimmed, padded, covered and thereafter inserted into the helmet proper. Another approach used in the prior art is to attach to the inside of a helmet shell several flattened tubes filled with an initially flexible material and to mount the tubeshell assembly on the pilot's head. The material within the tube hardens after a time and conforms to the pilot's head shape. This latter method is objectionable because the liner so formed contacts the head at relatively few contact points; after extended wear, the helmet weight bearing on these few contact points makes wearing of the helmet extremely uncomfortable. Both of the aforesaid techniques are unsatisfactory because they are generally cumbersome, time-consuming and usually result in an uncomfortably hot helmet because no provisions are made for air circulation within the helmet. More importantly these techniques employ equipment and methods which are ill-suited to constructing a helmet under field conditions.

SUMMARY OF THE INVENTION

Accordingly, it is an object of this invention to provide a lightweight helmet which can be custom fitted to a pilot's head. It is a further object of this invention to provide a lightweight helmet which can be formed in the field by an in situ foaming process. It is a further object of this invention to provide a lightweight helmet liner which contains air ducts integrated with the foamed structure through which cooling air can be passed to keep the pilot's head at a comfortable temperature. It is a further object of this invention to provide a lightweight, air cooled, form fitting helmet which will keep a proper attitude on the pilot's head during all aircraft maneuvers. These and other objects of the invention are achieved as follows:

A standard lightweight helmet shell perforated with small pressure relief holes over its surface is provided with a liner comprising a flat lightweight flexible sheet attached to a slightly heavier flexible sheet having a corrugated surface. The liner is divided into elongated pairs of cells formed from the spaces between the flat sheet and the corrugated sheet; each cell pair is permanently separated from adjacent cell pairs by a heat seal and hollow air duct attached to the corrugated sheet. One cell of each cell pair contains one component of a foam material such as polyethelene glycol or polyoxiporpylene glycol and the other cell of the cell pair contains the second component of the foam material such as carbamic acid or toluene diisocyanate and water. The partition between the two cells of the cell pairs is a temporary heat seal. When paddles, which span the temporary partition, are pulled, the partition or seal is severed and the two components of the impact absorbing styrafoam material are agitated by the paddles to thereby initiate the foaming process. As the foam expands the corrugated sheet of the liner material is pressed against the head of a pilot and conforms to the contours of his head and the flat sheet of the liner is pressed against the helmet shell and is pushed through the pressure relief holes in the shell. When the foaming action is complete, the helmet is a form fitted helmet.

Other objects, advantages and novel features of the invention will become apparent from the following detailed description of the invention when considered in conjunction with the accompanying drawings wherein:

Figure 1:
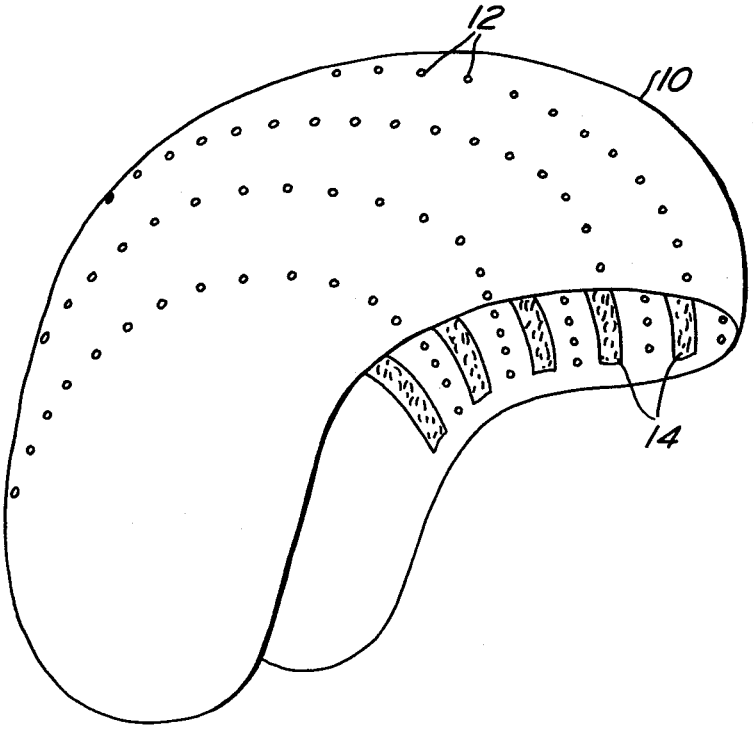
FIG. 1 shows a helmet shell constructed according to the invention.

FIGS. *2a* shows a perspective view of a helmet liner constructed according to the invention for the helmet shell of FIG. 1;

FIG. *2b* shows the inner surface of the helmet liner shown in FIG. *2a*.

Figure 4:
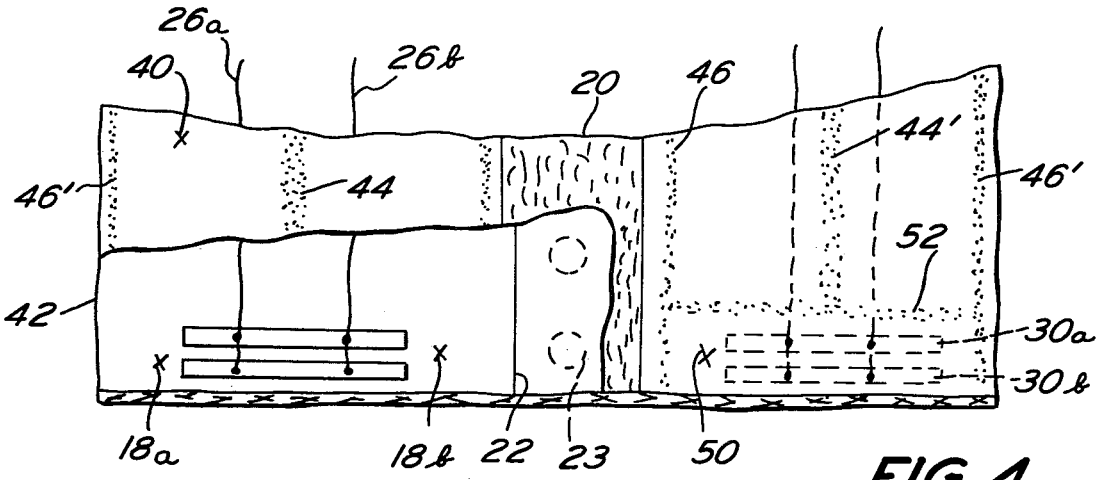

FIGS. *3a* and *3b* show transverse cross sectional views of a portion of the helmet liner of FIG. *2a* before and after foaming respectively; and FIG. 4 shows a detailed view of a portion of the forehead region of the helmet liner partially in section to reveal the partition severing paddles.

DESCRIPTION OF THE PREFERRED EMBODIMENT

Referring to FIG. 1, a helmet shell 10, made of a high impact strength plastic such as Dupont Kelvar$^R$, is shown. The helmet shell 10 is provided with a plurality of pressure relief holes 12 spaced over its surface. As will be explained more fully hereinbelow, the purpose of the pressure relief holes 12 is to allow the integument of the helmet liner to push through the holes 12 under the influence of expanding foam. (In addition, the presence of the holes 12 produces a further benefit by reducing the weight of the shell 10). The inside surface of the helmet shell 10 is provided with a plurality of hook and loop fasteners, such as Velcro strips 14 which mate with corresponding strips 20 provided on the helmet liner 16 shown in FIG. *2a*. This mating of strips provides a secure bonding between the helmet liner 16 and the helmet shell 10.

Referring to FIGS. *2a* and *2b*, a helmet liner 16 constructed according to the invention is shaped generally in the form of a semiblastoshpere. The liner 16 extends from the pilot's forehead to his neck. The liner 16 covers almost the entire cranial surface and is fabricated with a curvature that generally follows the contours of the human skull. As will be explained more fully hereinbelow, the helmet liner 16 is principally composed of two flexible sheets attached to each other in a special way so as to form a plurality of elongated chambers or cell pairs such as cell pair 18 or 18'. Each cell pair 18 is composed of two contiguous chambers or cells such as cells 18*a* and 18*b*. Each cell within the cell pair is separated from its partner by a removable partition or heat seal such as that indicated at 44 or 44' as will be explained more fully hereinafter. Each cell within the cell pair contains one component or reactant of a foamable mixture.

The cell pairs such as 18 or 18' are permanently separated from each other by relatively wider permanent partitions or heat seals (such as those indicated at 46 or 46' in FIGS. 3*a* and 3*b*) so that communication between adjoining cell pairs is never established. A plurality of strips are placed along and over the boundaries defining the permanent separations of the cell pairs 18. The strips 20 cooperate with the strips 14 located on the inner surface of helmet shell 10 and secure the helmet liner 16 to the helmet shell 10.

Nylon pull cords 26 terminate in a common pull tap 28. As shown more clearly in FIG. 4, each of the pull cords 26 is composed of two pull strings 26*a* and 26*b* each which extends along either side of the heat seal forming the temporary partition between cells of the cell pairs; the pull strings 26*a* and 26*b* are attached to paddles 30 located at the forehead edge of liner 16. As will be explained more fully hereinbelow, when the pull cords 26 are tugged, the paddles 30 are moved from the forehead edge to the neck edge of liner 16 by pull strings 26*a* and 26*b;* as the paddles 30 are moved the temporary partitions between cell pairs are severed by the paddles and the reactants contained within the cells 18*a* and 18*b* are agitated and admixed by the paddles to thereby initiate the foaming process.

Figure 2A:
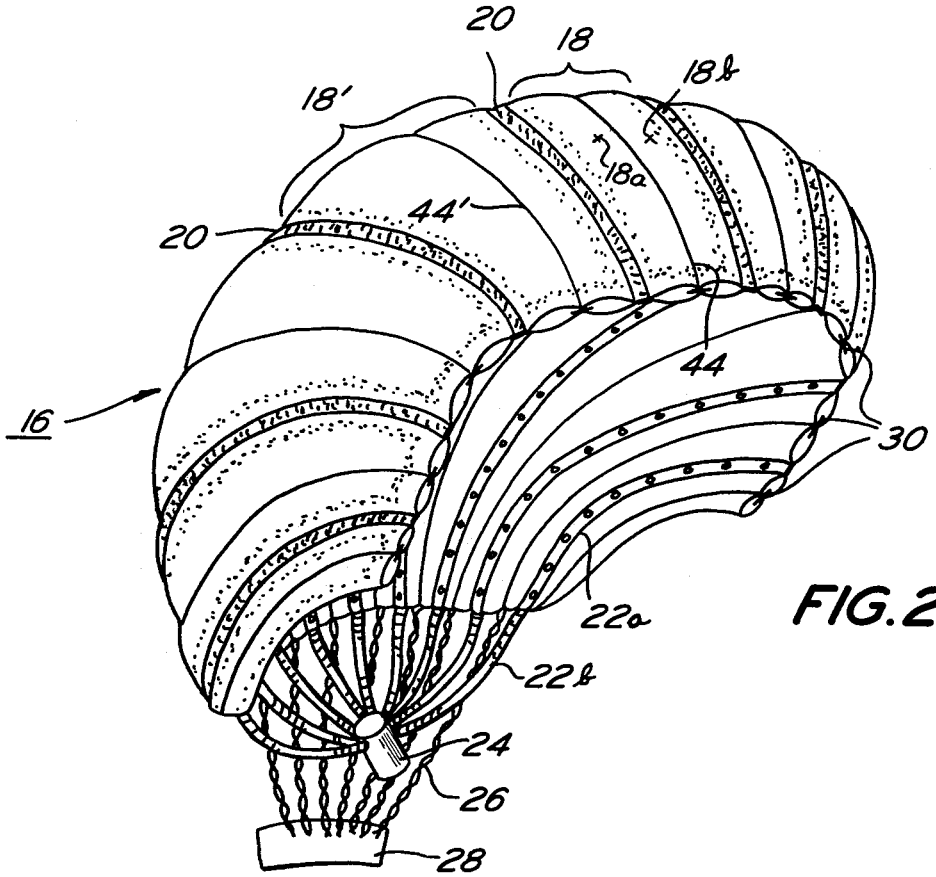
Figure 2B:
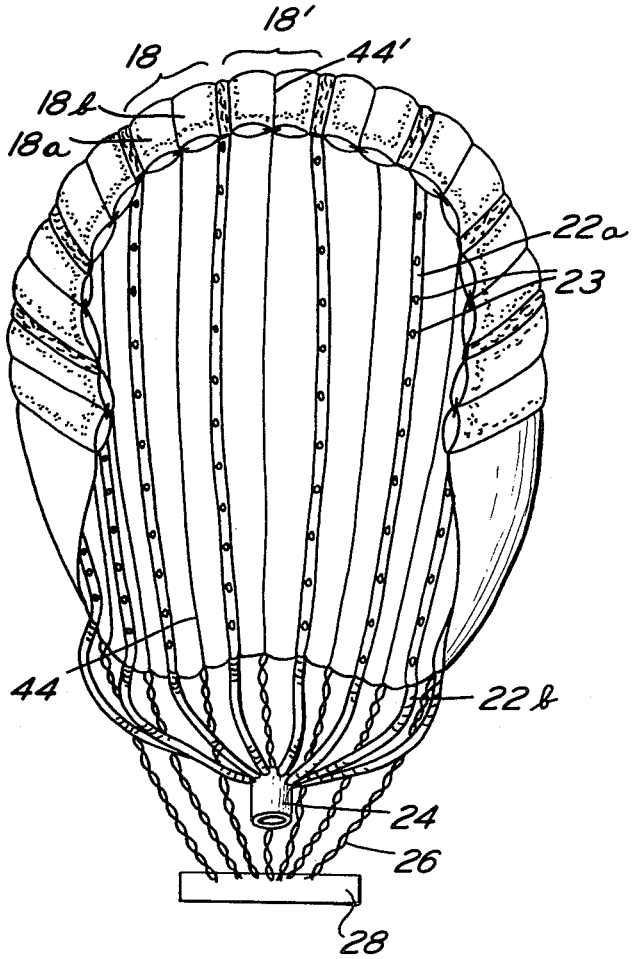

Referring to FIG. 2*b*, on the inner surface of the helmet liner 10 and also located along the permanent boundary between the cell pairs are a plurality of inflatable air tubes 22. The tubes 22 each have a first portion 22*a* which extends from the forehead edge of liner 16 to the neck edge. This first portion 22*a* has a plurality of punch-out perforations 23 which are removed after the foaming process is complete so as to form air vents as will be explained more fully hereinbelow. The punch out-perforations 23 have a diameter of approximately 1/16 inch and are spaced about ½ inch apart along the length of tube 22*a*. From the neck edge of liner 16, the tubes 22 are extended along a second portion 22*b* to an air supply coupling 24 where they all commonly terminate. Tube portion 22*a* can be formed from the same vinyl material as sheets 40 and 42 (FIG. 3*a*) but is at least twice the thickness of sheet 42; tube portion 22*a* must have a certain rigidity in order to properly space the liner from the pilot's head during the foaming process. Tube portion 22*b* can also be formed from vinyl but is is preferably impregnated with nylon fibers to enhance its stiffness. The enhanced stiffness of tube portion 22*b* imparts an increased mechanical strength to portion 22*b*, allows relatively longer lengths of tube portion 22*b* to be accommodated and facilitates interconnection of tube portions 22*b* with the air supply coupling 24. The tube portions 22*a* and 22*b* are interconnected by any suitable means.

Figure 3A:
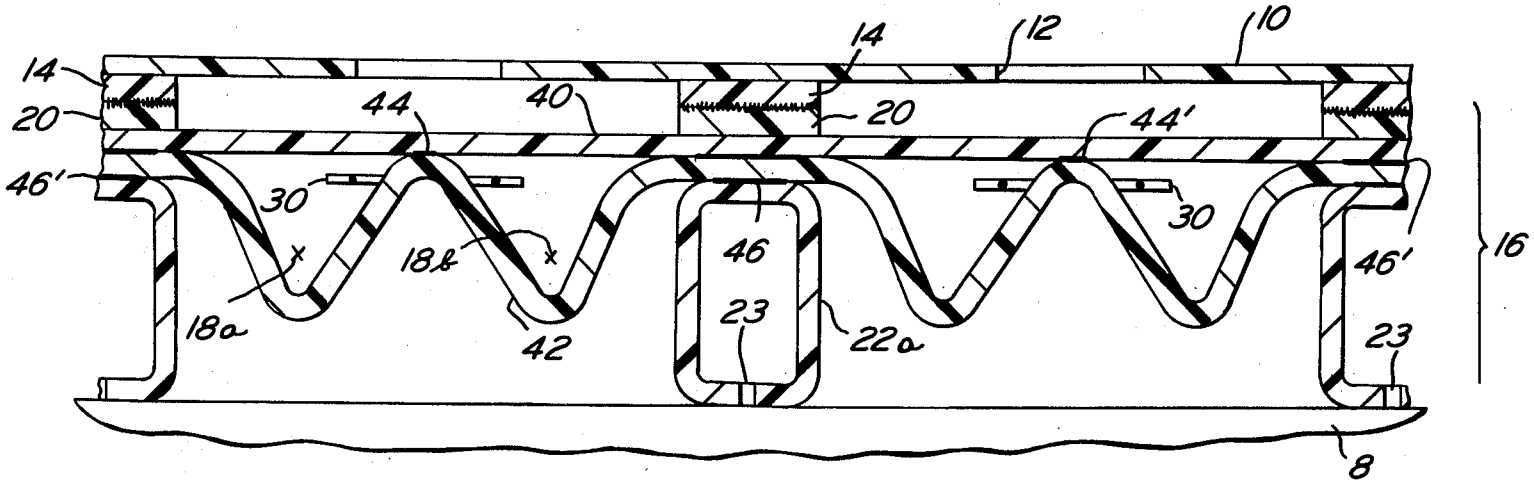

Referring to FIG. 3*a* the helmet liner 16 is shown positioned within helmet shell 10 by means of strips 14 and 20 prior to foaming. The air tubes 22*a* have been inflated by means not shown and press against the pilot's head 8. The inflated tubes 22*a* keep the liner 16 a proper distance from the pilot's head 8 during the foaming process.

The liner 16 is principally composed of flexible sheets 40 and 42. The material of which sheets 40 and 42 is formed is selected from those materials which in sheet or web form are flexible and slightly distensible, capable of being joined as by sealing or stiching, impermeable to the reactant mixture and the gas evolved therefrom, and not deleteriously affected by either the reactants per se or by the heat resulting from the exothermic nature of the foaming reaction. In a preferred form of the invention, the material of which the sheets 40 and 42 is formed is a vinyl film and the joining is accomplished by heat sealing. Other suitable materials possessing the aforesaid properties will occur to those skilled in the art.

With respect to sheet 42, sheet 40 is a generally flat sheet having approximately half the thickness of sheet 42. Sheet 42 has a corrugated surface and is temporarily joined to sheet 40 along longitudinal lines such as 44 and 44' to form the partition between cells 18*a* and 18*b* of cell pair 18. Sheet 42 is permanently joined to sheet 40 along longitudinal lines such as 46 and 46' to form the permanent partition between adjoining cell pairs. A separate air duct or tube 22*a* is attached to corrugated sheet 42 along the border lines (such as 46 or 46') forming the permanent partition between adjoining cell pairs. The air tube 22*a* is provided with punch-out perforations 23 which are removed after the foaming process is completed as will be explained more fully hereinbelow.

A plurality of strips (such as strip 20) are attached to sheet 40 above and along the permanent heat seal which forms the partition between cell pairs and mate with a like plurality of strips (such as strip 14) attached to helmet shell 10.

Each of the cell pairs, such as cell pair 18, is composed of individual cells such as cells 18*a* and 18*b* which are formed from the chambers created when sheet 42 is heat sealed or otherwise joined to sheet 40 along lines such as 44 and 44'. Cell pair 18 is separated from its adjoining cell pairs by the relatively wider heat seal along border lines such as 46 or 46'.

Cell 18*a* contains one component or reactant of a foam material, e.g., polyethylene glycol or polyoxypropylene glycol. Cell 18*b* contains a second component or reactant of the foam material, e.g., carbamic acid or toluene diisocyanate and water. The foaming components are introduced into their respective cells by a hypodermic needle or other suitable means after the cells are formed during the fabrication process. When the temporary partition or heat seal at border line 44, for example, is severed by the paddles 30 the two components in cells 18*a* and 18*b* are agitated and mixed to thereby initiate the foaming action.

Figure 3B:
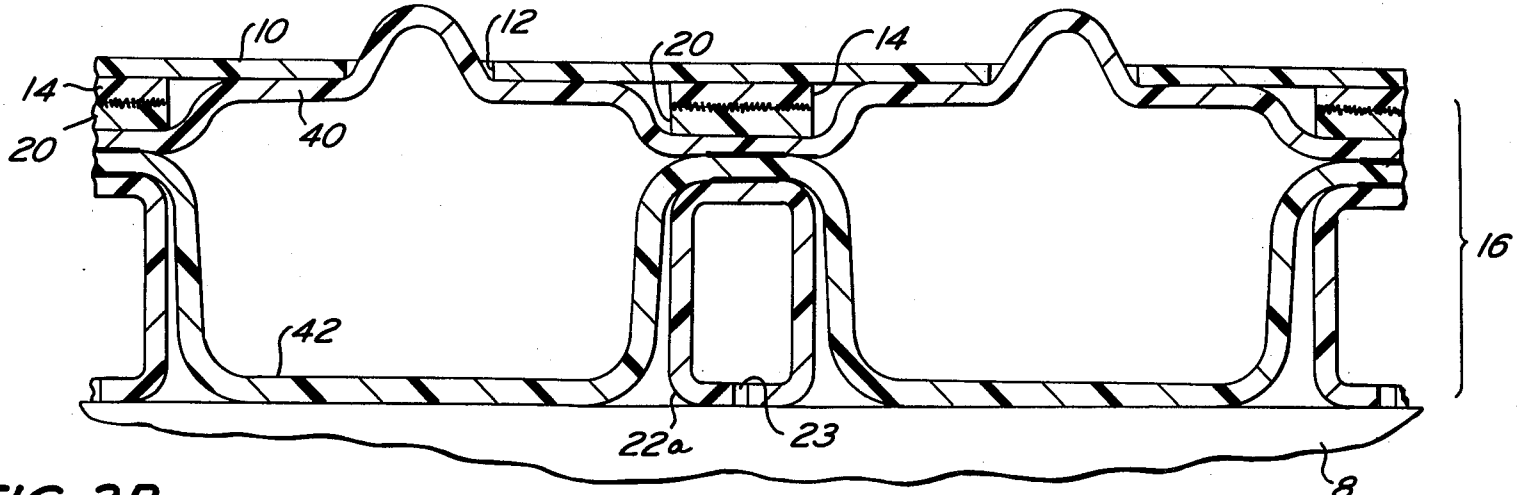

Referring to FIG. 3*b* the helmet liner is shown positioned within the helmet shell 10 after the foaming action is completed. The binary foaming components originally segregated within cells such as 18*a* and 18*b* have interacted and expanded to the extent that cells 18*a* and 18*b* lose their identity. The foam has pushed sheet 42 against the pilot's head and against the inflated air tubes. After the void between sheet 42 and the pilot's head is filled, excess foam pushes sheet 40 through the pressure relief holes 12. It is clear from the above description that flexible sheet 40 and the holes 12 of the shell 10 cooperate in such manner that a standard amount of reactant can be placed within each cell of the plurality of cell pairs 18. Hence there is no need for painstaking and accurate apportionments of the foaming reactants under field conditions since a standard or uniform amount of reactant can be placed in each cell of the cell pairs when the liner 16 is fabricated.

Referring to FIG. 4 two paddles such as 30*a*, 30*b* are shown lodged within a pocket 50. The pocket 50 is formed by the conjunction of the permanent partitions such as 46 and 46' between cell pairs 18 and a temporary partition 52 which spans the cell pair 18 at substantially a right angle with a temporary partition such as 44'. Attached to both paddles are pull strings 26*a* and 26*b* which are located in cells 18*a* and 18*b* respectively and which run generally parallel to the temporary partition 44 from the neck-edge of liner 16 to the pocket 50. Sufficient slack is allowed between the paddles 30*a* and 30*b* to provide a suitable distance between them when the pull strings 26*a*, 26*b* are tugged. When the pull strings are tugged, the paddles 30*a*, and 30*b* first sever the temporary partition 52 and thereafter sever the temporary partition 44. As the temporary partitions 52, 44 are severed, the heretofore separated reactants in cells 18*a*, *18b* are mixed together by the paddles 30*a*, 30*b* and the foaming process is initiated.

In one form of the invention the paddles 30*a*, 30*b* are drawn from the pocket 50 to the neck edge of the liner 16 where they remain with the pull strings 26*a*, 26*b* after the foaming process is completed and after the pull cords 26 have been severed from the liner 16. In this form of the invention the pull strings 26*a*, 26*b* and the paddle 30*a*, 30*b* are made from a suitable material, e.g. nylon, which does not react with the foam forming chemicals. (The pull strings are flexible but the paddles are rigid). In a second form of the invention, both the pull strings 26*a*, 26*b* and the paddles 30*a*, 30*b* are made from a suitable substance which does react with the foam-forming chemicals. The reaction is chemically retarded to allow the pull strings and the paddles to perform their function but is nevertheless chemically effective to virtually dissolve or disintegrate the pull strings and paddles. In both forms the paddles are not only rigid but also have sharp razor like longitudinal edges which facilitate the severing of the temporary partitions between the cells of a cell pair.

The method of fabricating a custom fitted helmet will now be set forth. The helmet liner 16 is secured to the helmet shell 10 by strips 20 and 14. The liner-shell combination is placed on the pilot's head 8 and the air ducts 22 are inflated. The inflated air ducts rest on the pilot's head 8 and create a spacing between the head and the remaining portions of the liner 16. A fishnet is placed over the outer surface of the shell 10 and tied under the pilot's chin. The fishnet keeps the liner-shell combination in place during the foaming process.

After the liner-shell combination has been firmly seated on the pilot's head, the pull tab 28 is tugged downwardly to move the paddles 30 via pull cords 26. As the paddles sever the temporary partitions 44, the foaming process begins and the cell pairs begin to fill with foam. The spacing adjacent the pilot's head is filled by the expanding liner integument and conforms to the pilot's head shape. If there is any excess foam, the liner integument is forced out through the holes 12 in the shell 10. The foaming process is normally completed in approximately 10 minutes.

After the foaming process is completed, the now custom-fitted helmet is removed from the pilot's head. The punch out perforations 23 in the air tubes 22*a* are removed and a lightweight, washable cotton knit cap is overlaid the inner surface of the liner 16. The cap is secured to the liner 16 by any suitable means. The cap provides a more comfortable contact with the pilot's head than would the liner 16 and the cap also serves to diffuse the cooled air provided by the tubes 22*a* via perforations 23.

Obviously many modifications of the present invention would occur to those skilled in the art in view of the foregoing. One such modification entails forming the liner 16 of individual cells rather than paired cells. Each cell terminates in a bag-like pocket at the forehead edge of the liner 16. The pocket is separated from the cell by a temporary partition or heat seal which spans the cell throat. Each pocket contains two chambers also separated by a heat seal. Each of the chambers contains one component or reactant of a foaming compound.

In operation, the heat seal across the throat of the cell is severed by suitable means and the foaming components are kneaded or massaged together by manipulation of the chambered pocket. As the foam is formed it is pushed through the throat of the cell into the cell proper. After the foaming action is completed the throat of the cell is resealed by a clip or other suitable means.

Another modification would dispense with the paddles and sew or otherwise integrate the pull strings within the partition separating cells 18*a* and 18*b*. As the pull cord 26 is tugged the intertwined pull strings 26*a*, 26*b* would rupture the partition.

It is clear from the above that the in situ foaming technique of the present invention is not limited to forming custom fitted pilot helmets. Rather the technique may be used to form a foamed packing about a variety of articles or may be used to form a liner between body parts and apparel other than helmets, e.g. ski boots.

Obviously, many modifications and variations of the present invention are possible in the light of the above teachings. It is therefore to be understood that within the scope of the appended claims the invention may be practiced otherwise than as specifically described.

I claim:

1. A liner comprising:

a plurality of elongated flexible cell pairs connected together side by side to form a sheet, each pair forming two chambers separated by a partition and respectively containing first and second components combinable to produce a foam substance; and severing means for removing said partition thereby enabling said first and second components to combine and inflate said chambers with said foam substance.

2. A liner according to claim 1 wherein:

said first component is a glycol selected from the group consisting of polyethylene glycol and polyoxipropylene glycol; and said second component is carbamic acid.

3. A liner according to claim 1 wherein:

said second component is toluene di-isocyanate and water.

4. A liner according to claim 1 wherein said severing means comprises:

a paddle spanning each of said partitions at one end thereof;

a first string movable within one of said two chambers and connected to a first end of each of said paddles;

a second string movable within the second of each of said two chambers and connected to a second end of each of said paddles; and said first and second strings extending from said paddles to the other ends of said partitions.

5. A liner according to claim 4 further including a plurality of ventilating air ducts interposed between said plurality of cell pairs.

6. A liner according to claim 5 further including:

a first component of a foamable substance lodged within a first chamber of said cell pair; and a second component of a foamable substance lodged within a second chamber of said cell pair.

7. A liner according to claim 6 wherein:

said first component is a glycol selected from the group consisting of polyethelene glycol and polyoxipropylene glycol; and said second component is carbamic acid.

8. A liner according to claim 7 wherein:

said second component toluene di-isocyanate and water.

9. A liner comprising:

a flexible sheet;

a plurality of elongated flexible cells attached side by side to said sheet, each cell forming a pair of chambers separated by a severable partition, and said chambers of said pairs respectively containing first and second components combinable to produce a foam substance;

a plurality of ventilating air ducts, each duct interposed between adjacent cells; and severing means for removing the partition separating the two chambers, said means including paddles spanning each of said partitions at one end, and first and second strings movable within respective ones of said pairs of chambers and connected to respective ends of said paddles, said first and second strings extending from said paddles to the other end of said partitions.

* * * * *